US007582819B1

(12) United States Patent
Beddow et al.

(10) Patent No.: US 7,582,819 B1
(45) Date of Patent: Sep. 1, 2009

(54) ADJUSTABLE STRAP FOR A GUITAR

(76) Inventors: Neil S. Beddow, 1096 13th St. SW., Naples, FL (US) 34117; Brian Beddow, 1096 13th St. SW., Naples, FL (US) 34117

( * ) Notice: Subject to any disclaimer, the term of this patent is extended or adjusted under 35 U.S.C. 154(b) by 0 days.

(21) Appl. No.: 12/148,181

(22) Filed: Apr. 18, 2008

(51) Int. Cl.
*G10D 3/00* (2006.01)

(52) U.S. Cl. ..... 84/327

(58) Field of Classification Search ..... 84/421, 84/327, 329

See application file for complete search history.

(56) References Cited

U.S. PATENT DOCUMENTS 4,484,379 A * 11/1984 Appelt et al. ..... 24/197

6,250,525 B1 * 6/2001 Lehoux ..... 224/257

* cited by examiner

*Primary Examiner*—Kimberly R Lockett

(57) ABSTRACT

A device for instantly lengthening a support strap on a guitar depending on the players mode of playing and the rhythm of the tune. The device consists of a base plate which has the strap trained therein and is carried on a player's upper body. The base plate has at a lower end thereof a hinge which a movable counter plate thereto. The movable counter plate has a multiple of openings thereon through which a guitar strap can be threaded at predetermined locations. When the movable counter plate is in an up position it is arrested at that location and the guitar strap is doubled back upon itself. When the tune or the rhythm thereof requires a change in beat, the movable counter plate can instantly be released to assume a straight down position, whereby the strap is lengthened and the guitar can be played at a lower position of the body of the player.

5 Claims, 3 Drawing Sheets

FIG,3
12
15
15A
15A
15A
15A
15A
9
9
10
14
13
12
11
8
8a
9
6
5
4
2
3
1
7
4
1
6
6

ADJUSTABLE STRAP FOR A GUITAR

BACKGROUND OF THE INVENTION

The invention is directed to a carrying strap of a guitar. Guitars have a single strap that is connected to an upper end of the fretted neck and the other end is connected to a bottom of the guitar body. The strap is trained over the shoulder of the player and then around the back and under the arm of the player and then down to the bottom of the guitar. The strap is adjustable by way of a buckle to comfortably suit the different heights of different players.

BRIEF DESCRIPTION OF THE INVENTION

The art of playing a guitar involves many positions of the player and many positions of the guitar on the player's body. When playing a guitar, the guitar is normally located on the player about midway across the chest of the player. This is a comfortable position for the player when playing a melody or accompanying a singer by providing the background cords of the tune. However, when the beat of a tune changes dramatically, the player must produce a heavy beat which is best being produced when the guitar is at a much lower position so that the strumming hand is at about the length of an arm of a player. Therefore, it is desirable, that the length of the strap supporting the guitar around the back of the player, be changed immediately as the tune of the music changes its beat dramatically. This an object of the invention. This is accomplished by the addition of a device in the strap that allows an immediate change in the length of the strap.

BRIEF DESCRIPTION OF THE DRAWINGS

FIG. 3 shows the plate of FIG. 1 and an additional hinged plate;

DETAILED DESCRIPTION OF THE INVENTION

Figure 1:
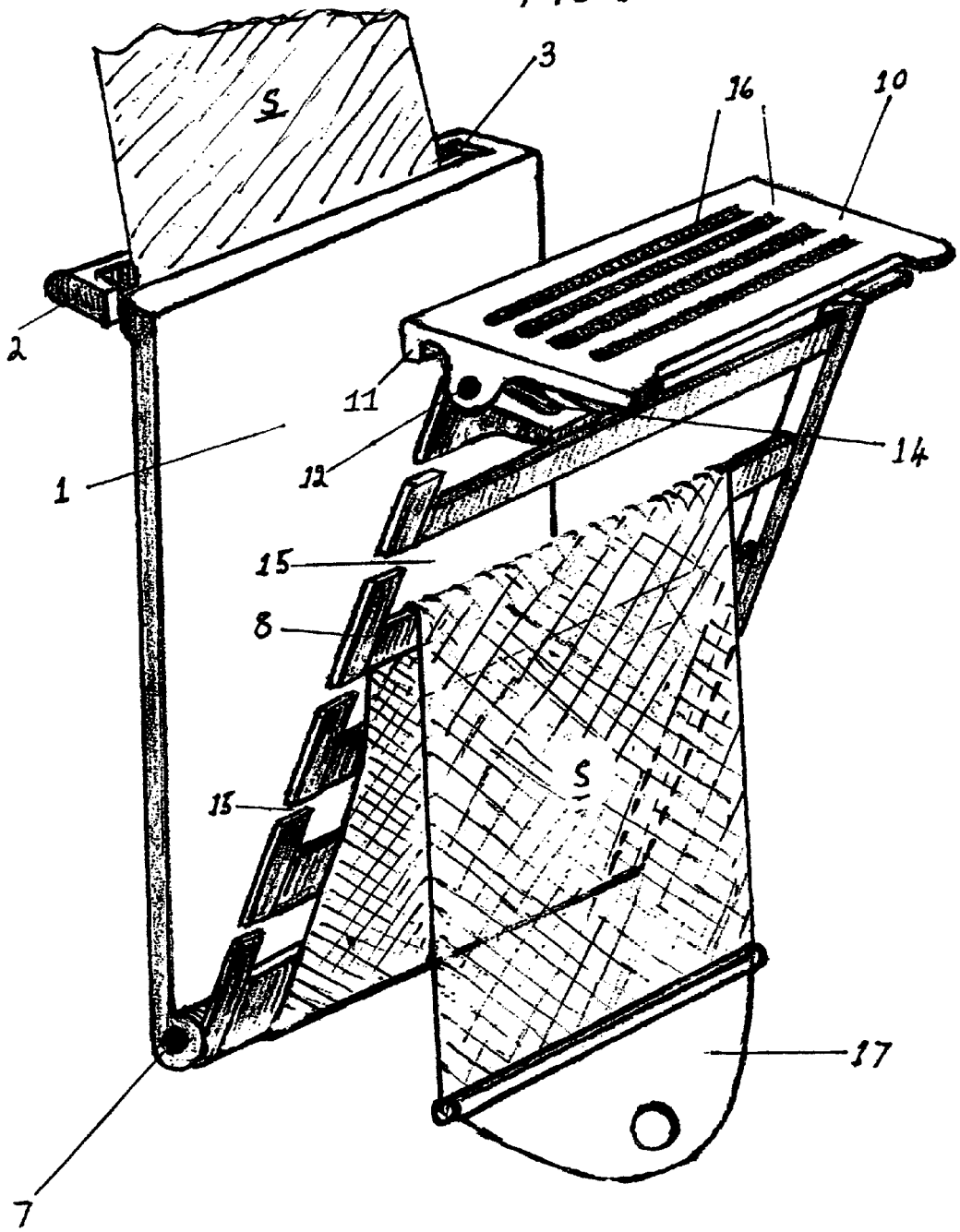
FIG. 1 is a perspective view of the strap length adjusting device.
Figures 2, 4:
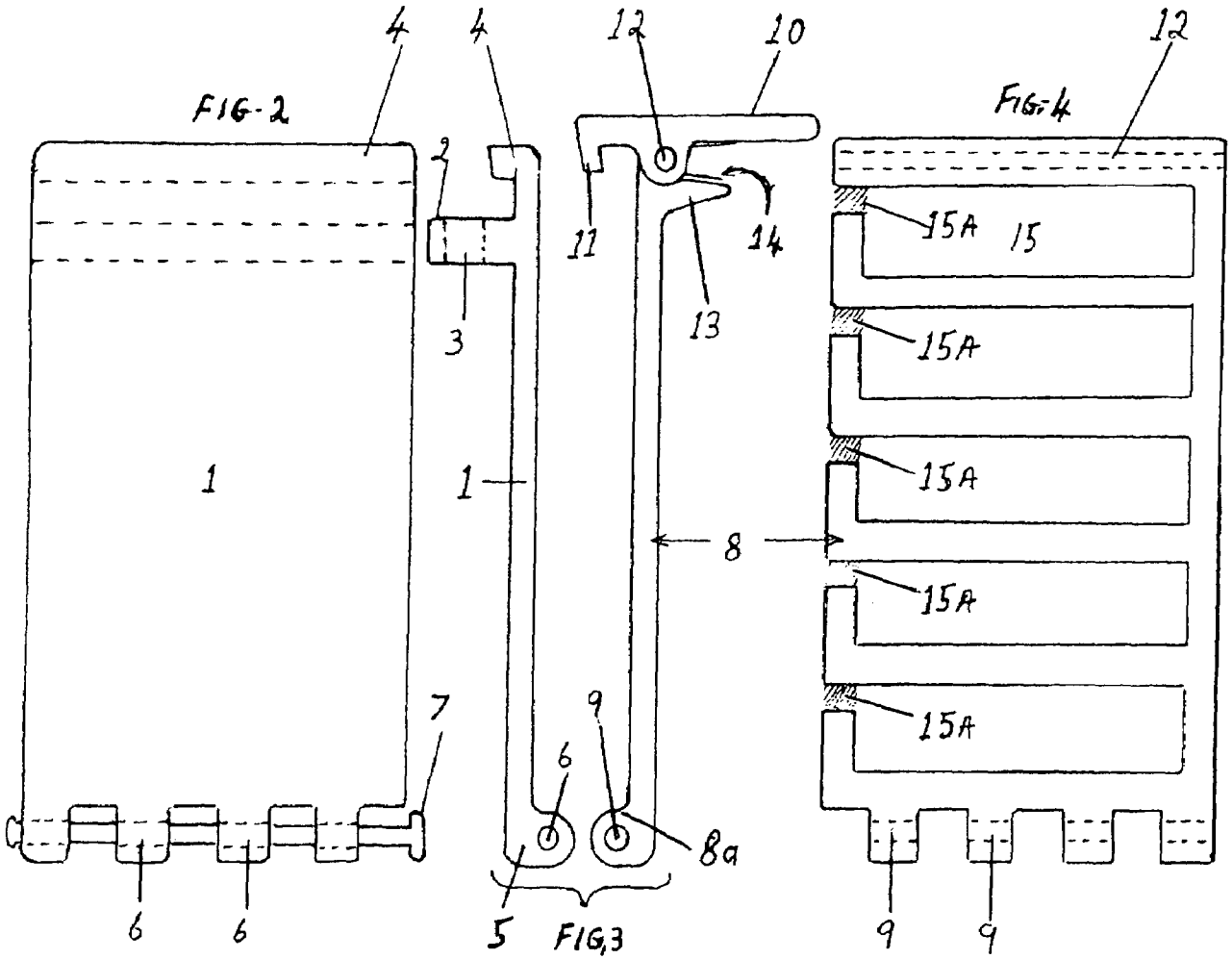
FIG. 2 is a base plate which forms part of the device of FIG. 1.
FIG. 4 shows a front view of the additional plate of FIG. 3.
Figures 5, 6, 7:
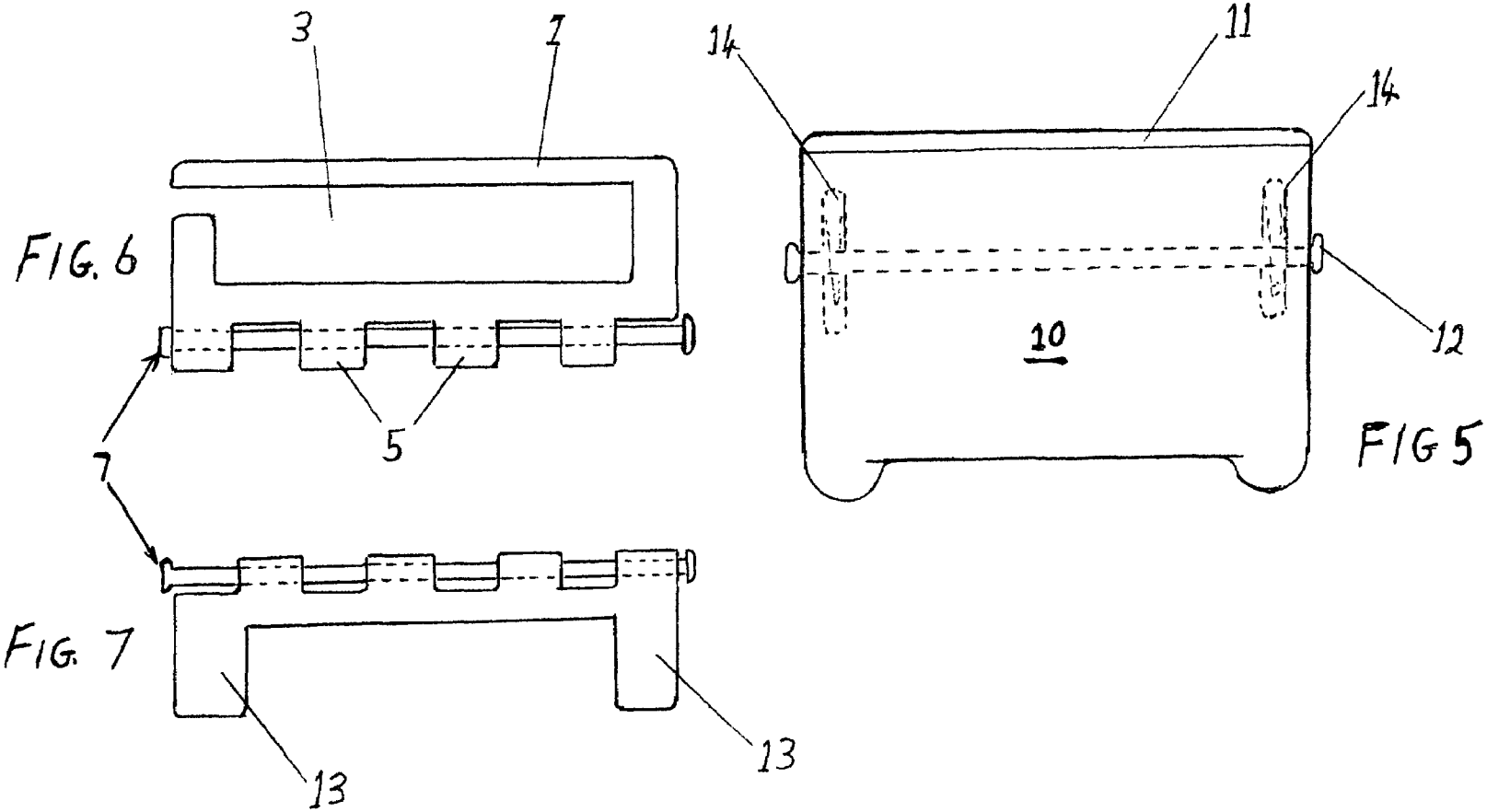
FIG. 5 is a hinged plate as an element of the additional plate of FIG. 3.
FIGS. 6 and 7 show the base plate and the additional plate as they will be hinged together.

FIG. 1 is a perspective illustration of the strap length adjusting device. The device consists of a base plate 1 which is located in front of the guitar player with the guitar strap S passing there behind and the base plate is thereby held against the body of the player. At an upper end of the base plate 1 the strap S is guided through a slot 3 which is located in a transverse off-set 2. As can be seen in FIG. 3, the base plate has at its top a transverse nose 4 which will be explained below. At the bottom of the base plate 1 there is an off-set collar 5 which has an opening 6 therein for the reception of a hinge pin 7 (FIGS. 6 and 7). The hinge pin 7 will pivotally connect to an additional and movable counter plate 8 by way of another off-set collar 8*a*. The hinge pin 7 will pass through openings 6 and 9 to pivotally connect the two plates 1 and 8 together. The two off-set collars 5 and 8*a* assure a perfect parallelism between the plates. The movable counter plate 8 has at its top a pivotal arrest plate 10 attached thereto by way of a hinge pin 12. The arrest plate 10 is biased in a counter clockwise direction (as seen in FIG. 1) by way of a coil spring 14 which is on one side biased against a counter off-set plate 13 and on the other side against the underside of the arrest plate 10. The counter off-set plate extends from the movable counter plate 8 at a right angle and under the arrest plate 10. The arrest plate 10 has a depending nose 11 thereon which will move behind the nose 4 when the plates 1 and 8 are moved into contact with each other. The depending nose 11 will remain behind the nose 4 because of the bias of the spring 14 until released.

The movable counter plate 8 has openings 15 therein so that the strap S can be threaded there through, whereby the strap S will double back on itself when the two plates 1 and 8 are brought together. The various openings 15 in the movable counter plate can be used to train the strap through the various openings depending on the overlap desired. The predetermined overlap would depend upon the height of the guitar player. The top of the arrest plate 10 has ribs 16 thereon to increase the friction between the plate and the fingers of the player.

It is also preferred that each of the openings 15 have a slit 15*a* therein. So that the strap can be passed into any of the openings by way of the slits 15*a*. The material from which the various parts are made is a semi-rigid plastic. However it is flexible enough so that when the movable counter plate 8 is twisted sideways, the slits 15*a* will opening just enough to admit the strap S there through, however, the straps cannot exit by themselves.

FIG. 5 is a top view of the arrest plate 10 showing the hinge pin 12 in phantom and the spring 14 in simulated openings. The nose 11 is shown in a phantom line.

FIGS. 6 and 7 show the bottom and hinge arrangement of the plates 1 and 8. The FIGS. 6 and 7 look downwardly from the top whereby the opening 3 can be seen and the off-set collars 5. FIG. 7 also looks downwardly whereby the off-set collars 8*a* can be seen and the counter off-set 13 which act to create a bias in the spring 14 as a counter point.

OPERATION

From all of the above it now be seen how the strap lengthening device will operate. When in a normal playing mode, the guitar player will connect the two plates 1 and 8 together by way of arresting the nose 11 behind the nose 4 whereby the strap S, which is doubled over on itself, will allow the player to play the guitar at an upper location of the body to thereby play the melodies or a plain cord accompaniment. However, if the tune, that is played, changes dramatically, all the player has to do is hit the arrest plate which will thereby be released from its locked or arrested state. Thereby, the movable counter plate 8 will swing downwardly which will change the state of the Strap S from an overlap to a straight line which at that point will allow the player to play the guitar at a low point on his/her body to thereby beat out the rhythm required to enhance the beat of the tune.

We claim:

1. A device for instantly changing the length of a guitar supporting strap, said device including a base plate supported by said strap, said base plate having a bottom thereof a movable counter plate supported by a hinge, said movable counter plate being arrested to said base at a top thereof by way of a releasable arrest plate, said movable counter plate having openings therein, said strap is threaded through said openings so that when said movable counter plate is an arrested position, said strap is doubled back on itself, said strap will move to a straight line state when said releasable arrest plate is released, whereby said guitar can be played at a lowered position on the body of a player.

2. The device of claim 1, wherein said base plate has a nose at a top thereof and said movable counter plate has a depending nose thereon, whereby said depending nose engages said nose on said base plate to arrest the movable counter plate against said base plate.

3. The device of claim 2 including means for biasing said depending nose into an arrested position.

4. The device of claim 3, wherein said means for biasing is a coil spring.

5. The device of claim 1 including slits in any of said openings in said movable counter plate for admitting said strap into said openings.

* * * * *